US005887279A

United States Patent [19]

Elting et al.

[11] Patent Number: 5,887,279

[45] Date of Patent: Mar. 30, 1999

[54] SURGICAL GARMENT FOR A PATIENT

[76] Inventors: James J. Elting, 18 Brigham Rd.; Vincent N. Toscano, R.D. #2, Box 310 E, both of Oneonta, N.Y. 13820

[21] Appl. No.: 203,789

[22] Filed: Mar. 1, 1994

[51] Int. Cl.[6] ..... A41D 13/00; A41D 27/00

[52] U.S. Cl. ..... 2/69; 2/83; 2/114; 2/912; 2/914

[58] Field of Search ..... 2/1, 2.14, 2.15, 2/2.16, 78.1, 78.2, 78.3, 78.4, 914, 75, 80, 83, 2.17, 69, 912

[56] References Cited

U.S. PATENT DOCUMENTS

| | | | |
|---|---|---|---|
| 302,901 | 8/1884 | Fenne | 2/114 |
| 818,351 | 4/1906 | Clark | 2/114 |
| 1,489,046 | 4/1924 | Thompson | 2/114 |
| 2,374,643 | 5/1945 | Boettcher | 2/114 |
| 2,504,534 | 4/1950 | Kephart et al. | 2/114 |
| 2,735,283 | 2/1956 | Schuessler | 2/202 |
| 4,622,699 | 11/1986 | Spriggs | 2/114 |
| 4,651,353 | 3/1987 | Walden | 2/114 X |
| 4,737,995 | 4/1988 | Wiley | 2/114 |
| 4,964,173 | 10/1990 | Görden et al. | 2/114 |
| 4,977,622 | 12/1990 | Schley | 2/114 |
| 5,027,438 | 7/1991 | Schwarze et al. | 2/114 |
| 5,097,535 | 3/1992 | Dye et al. | 2/114 |
| 5,222,258 | 6/1993 | Mucci et al. | 2/114 |

OTHER PUBLICATIONS

Beck, William C., "Thermal Comfort for the Patient During Surgery: Comfort, a physiological as well as a psychological phenomenon", The Guthrie Journal, vol. 82/No. 4, Fall 1993, pp. 159–160.

*Primary Examiner*—Jeanette Chapman
*Attorney, Agent, or Firm*—Brenda L. Speer

[57] ABSTRACT

The surgical garment of the present invention is to be worn by a patient. The garment is preferably a three-piece garment and is comprised preferably of polypropylene fabric. The garment pieces are a hood piece to cover a patient's head and neck, a top piece to cover a patient's torso and upper extremities and bottom pieces to cover a patient's lower extremities. The garment assists a patient in maintaining homeostasis or a constant body temperature before, during and after surgery. There is at least one opening within the garment to allow access to a patient for surgical procedures, placement of an intravenous tube into the patient, placement of a monitor sensor upon the patient, administration of a shot to the patient and other necessary medical procedures.

8 Claims, 1 Drawing Sheet

SURGICAL GARMENT FOR A PATIENT

FIELD OF THE INVENTION

The invention relates to a garment worn by a patient during surgery. The garment assists the patient in maintaining a constant body temperature.

BACKGROUND OF THE INVENTION

The ambient temperature in an operating room is low for a variety of reasons. A surgeon typically has on many layers and items of clothing, such as underwear, a scrub suit or pajamas, paper boots, an occlusive/impervious gown, a hat, a hood and often a "space suit" for air exchange. Accordingly, the surgeon becomes very hot due to the many body heat trapping layers of clothing which he or she is wearing. An operating room is typically kept at a temperature which will keep the surgeon comfortable which is from about 20° C. to about 24° C. The surgeon is kept comfortable at the expense of the comfort of the patient. Therefore, a patient is not comfortable in an operating room.

Humans are isothermic or warm-blooded. A healthy human's average body temperature is about 36.5° C. and this body temperature remains within about one degree Celsius, from about 35.5° C. to about 37.5° C., despite wide variations in environmental temperatures. The mechanism by which the human body maintains a constant temperature is called thermal homeostasis. The mechanism is mediated by the hypothalamus of the brain. With a variety of means, the hypothalamus, along with human assistance, keeps the body at a comfortable temperature. Such means are insulation or clothing, ambient temperature control, humidity control and air movement regulation.

A comfortable ambience is one which does not trigger these homeostatic mechanisms, or an environment in which one would feel comfortable wearing clothing suitable to the space, activity and season. The requirements of the surgical operating room differ from most others because clothing suitable to the activity is so different. The patient is relatively naked in the operating room and his or her viscera may be exposed, both of which contribute to the surface exposure of the body to ambient conditions. An operating room is not a comfortable ambience for a patient, due to these and the aforementioned operating room temperature conditions.

An operating room temperature below about 21° C. will typically result in a patient body temperature below about 36° C. This body temperature lowering occurs despite pre-warming of intravenous and irrigation solutions and humidifying anesthetic gases prior to administration to a patient during surgery. Because of the relatively cool operating room temperature, patients undergoing surgery expend a great deal of energy in an effort to maintain body temperature. For the body to fuel its thermoregulatory physiology in an attempt to maintain body temperature, as much as about 40% of a patient's cardiac output may be required. This output is a significant energy expenditure by the body, particularly in an elderly or a debilitated patient.

Accordingly, 20% of patients entering a post-anesthesia room are shivering from hypothermia. A patient is considered hypothermic when his or her body temperature is less than about 35.8° C. The hypothermia results not only from a general or local anesthesia administered for surgery, but also from systemic narcosis due to narcotics administered concomitant with the anaesthetic agent or agents, both of which render a patient poikilothermic or cold-blooded and, thus, reactive to ambient temperatures.

The ability of a patient to maintain homeostasis is further compromised by the fact that a patient wears little if any clothing in an operating room. A patient is fundamentally naked, or at best wears a "johnny shirt", in the operating room. The johnny shirt affords a patient minimal body coverage, is loose-fitting and is made of a cotton or cotton-blend fabric. With all of these factors combined, the johnny shirt has no body heat retention properties.

Patients have been clothed with warm blankets and even encased in metal foil in an attempt to maintain patient body temperature during surgery, but neither of these methods have achieved wide acceptance, except for post-surgery care. In veterinary medicine heated operating tables are used or surgery is carried out on heating pads to maintain the body temperature of the animal. However, neither of these methods are practiced in human medicine, because not enough operating table surface area can be warmed; and there is a larger gradient between operating table temperature and operating room ambient temperature than occurs in veterinary operating rooms.

The problem of maintaining the body temperature of a surgeon and a patient in the operating room has been recognized; however, solutions have been proposed only for maintaining the body temperature comfort of the surgeon. For instance, U.S. Pat. No. 5,027,438 by Schwarze et al., issued on Jul. 2, 1991, for "Operating Room Clothing with Coated Fabric", generally discloses a system of operating room garments for a surgeon. The garment system consists of scrub pants which are worn under a tabard for protection against bacterial transmission. Over both of these garments, a surgical gown is worn which has water repellant, bacteria barrier panels for the sleeves and the chest area (from neck to mid-thigh). The system provides a surgeon with a choice of garment selection, depending upon the surgical procedure involved. Again, the garment of this patent is directed toward the needs of a surgeon, not those of a patient.

The problem of maintaining both surgeon and patient comfort is also recognized by William Beck, M. D., FACS, *Thermal Comfort for the Patient During Surgery: Comfort, a Physiological as well as a psychological phenomenon*, The Guthrie Journal, Volume 82/No. 4, Fall 1993. Once again though, a solution is provided only for maintaining surgeon comfort. Beck proposes a complete revision of the current gowning and draping system for a surgeon which consists of a light, simple comfortable gown for protection from dry penetration with a plastic over-gown which would cover the front of the torso and arms of the surgeon, thus providing protection from wet penetration. Beck's approach is to make the surgeon comfortable in a room temperature designed more for patient comfort. Yet even with this approach, a patient will still suffer body temperature discomfort, because the patient is minimally clothed and under anesthesia during surgery, both of which contribute to compromising a patient's body temperature.

There is a need to maintain patient body temperature during surgery. Yet, as is evident from the prior art discussed, no solution to this problem has been proposed. Therefore, there is a need for a means by which to maintain patient body temperature in an operating room. The present invention discloses and claims a garment to be worn by a patient in an operating room which assists the patient in maintaining body temperature.

SUMMARY OF THE INVENTION

Figure 1:
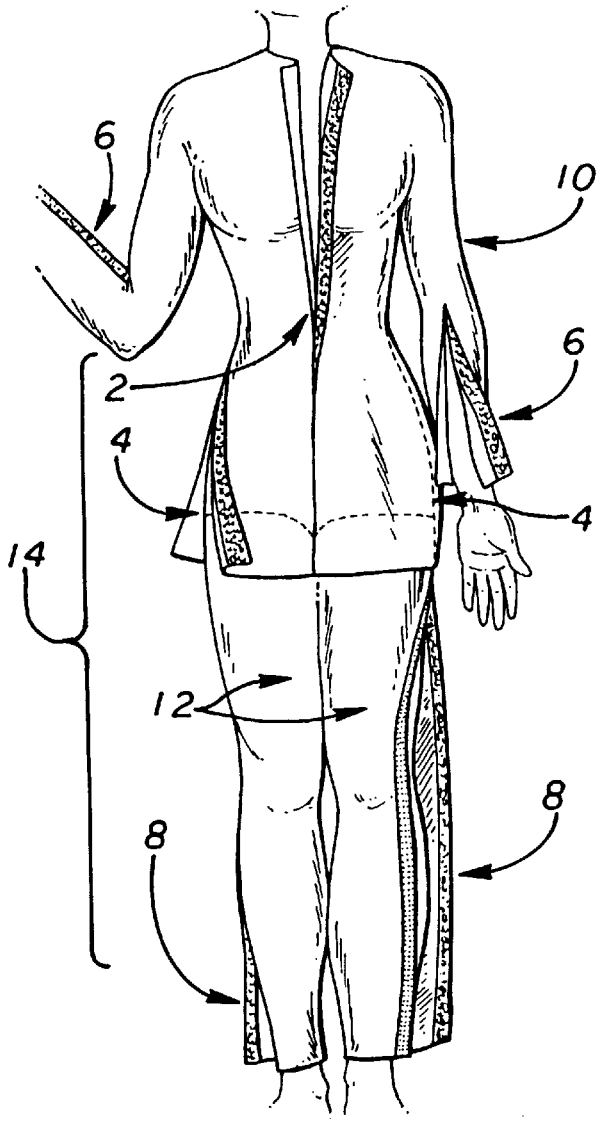
FIG. 1 is a frontal view of a patient clothed in the garment of the present invention.

The garment of the present invention is a form-fitting surgical garment for assisting a patient in maintaining homeostasis; wherein the garment has with at least one closable opening therein to allow access to the patient. The garment may be a one-piece garment, preferably is at least a two-piece garment and most preferably is a three-piece garment. The preferred three-piece garment is comprised of a top piece for covering a torso and upper extremities of a patient, a hood piece for covering a head and neck of a patient and bottom pieces for covering lower extremities of a patient.

The garment may be comprised of a fabric which permits cutaneous surface temperature stabilization of the patient, such as a polypropylene fabric; a waterproof, breathable fabric; an insulating, water-absorbent fabric; or of silk; wool; cotton; rayon or polyester fabrics. Preferably, the garment is comprised of polypropylene fabric.

The closable openings are in the top piece, the hood piece and the bottom pieces of the garment. These openings are along the anterior midline, left lateral, right lateral, left forearm and right forearm of the top piece; along the left lateral and right lateral of the respective left and right bottom pieces; and along the anterior neck of the hood piece.

The openings in the garment are closable with hook and loop tape, snap, button or zipper closures. The preferred closure is hook and loop tape.

DETAILED DESCRIPTION OF THE INVENTION

For a patient undergoing a surgical procedure, hypothermia is generally detrimental. With the lowering of the patient's body temperature, the patient's cardiac work is increased, oxygen release to the tissue is diminished, blood viscosity is increased, fluid volume is decreased, potassium content is decreased, potential for cardiac arrhythmia is increased and the immune system is altered at the cellular or enzymatic level. As the patient rewarms immediately post-operative, the patient may experience a sudden loss of blood pressure as the small blood vessels return to a more normal resistance pattern. Furthermore, the patient's ability to metabolize drugs, particularly those drugs used during anesthesia, may be compromised. This compromise may result in the unwanted occurrence of prolonged sedation and muscle relaxation of the patient.

Performing surgery in a cool environment places tremendous physiologic demands on a patient who may already be metabolically compromised. The recovery or rewarming period can be equally dangerous. Therefore, it is advantageous to assist the human thermoregulatory physiologic process in the intra-operative period. An appropriate and effective means by which to do so is with the garment of the present invention.

The garment of the present invention may be comprised of a one-piece garment or a multiple-piece garment, but preferably is a multiple-piece garment and most preferably is a three-piece garment. A multiple-piece garment, as that of the present invention, allows for the area of a patient's body to be operated upon to be exposed. Also, the garment may be of different sizes with varying height and weight combinations to accommodate body sizes from infant to adult. The three-piece garment of the present invention comprises a top piece, a hood piece and bottom pieces. Each of these pieces may or may not be attached to one another by any suitable attachment means such as hook and loop tape (for instance, "VELCRO"®), snaps, buttons, zippers or the like.

As would be obvious to one of ordinary skill in the art, the garment may be modified to meet the needs of a particular patient or a particular surgical procedure. For instance, the upper extremities may be covered with sleeves which are detachable from the top piece. The bottom pieces may be attached together, or, preferably may be detached from one another. The bottom pieces may or may not be held on at the thigh, for instance, with elastic. Additionally, the top piece may or may not cover the hands and the bottom pieces may or may not cover the feet.

Each piece of the garment has at least one opening therein secured by a closure. Any type of suitable closure would be appropriate such as a hook and loop tape, snaps, buttons, zippers or the like. The preferred closure is a hook and loop tape closure because of its ease of operation. The openings are preferably strategically placed within the garment to allow access to a patient as necessary for placement of intravenous tubes, monitor sensors, etc. into or upon the patient and for surgical access to the area of the patient upon which to be operated. The openings are more preferably placed within the garment in the top piece for access to a patient's torso and upper extremities, within the hood piece for access to a patient's neck and within the bottom pieces for access to a patient's lower extremities. Most preferably, and as would be obvious to one of ordinary skill in the art, the openings are placed within the garment as dictated by the particular surgery being performed for access to that area of the patient's body required by the surgery.

The garment of the present invention may be loose- or form-fitting, but preferably is form-fitting. A form-fitting garment has a greater ability to retain body heat than does a loose-fitting garment and, therefore, a form-fitting garment is better for assisting a patient in maintaining homeostasis. Accordingly, the garment of the present invention is advantageous for patient comfort and health and may be worn before, during and after surgery, as well as in non-surgical applications for assisting a patient in maintaining a constant body temperature. The body temperature of a patient wearing the garment of the present invention is maintained at about 36.5° C., the average body temperature, or from about 35.5° C. to about 37.5° C.

The garment of the present invention preferably covers a patient's torso, arms and legs, more preferably covers a patient's torso, arms and legs, head and neck and most preferably covers a patient's torso, arms and legs, head and neck, and hands and feet. The area of a patient's body to be operated upon is most preferably not covered during the course of the operation, as well as during the post-operative recovery period. Less preferably, the operative area of the patient's body may remain covered, but accessed via one or more of the openings on the garment of the present invention.

The garment of the present invention may be disposed of after use or cleaned and re-used as dictated by practicality and medical regulations. Additionally, after surgery the garment of the present invention may be left on a patient or replaced with a clean garment of the present invention in order to continue to assist the patient with maintaining homeostasis. Due to the design of the garment, medical personnel would have access to the patient for intravenous tube and monitor sensor placement into and upon the patient, shot administration to the patient and other necessary medical procedures before, during and after surgery.

The garment of the present invention may be constructed from many alternative fabrics which may or may not be aseptic. Preferred fabrics are polypropylene; a water-proof, breathable fabric, such as "GORE-TEX"® (available through W. L. Gore & Associates, Inc.); an insulating, water-absorbent fabric, such as "NEOPRENE"®; silk; wool; cotton and suitable synthetic fabrics, such as rayon, polyester and the like. A suitable fabric for construction of the garment of the present invention would be any fabric other than those previously discussed which has insulating properties, can be form-fitting to a patient's body and which can absorb moisture from the surface of a patient's skin or which is breathable and can allow moisture to evaporate from the surface of a patient's skin.

However, the most preferred fabric for construction of the garment of the present invention is polypropylene. Polypropylene is the most preferred fabric because it best assists a patient in maintaining an optimal constant body temperature. The fabric maintains this optimal constant body temperature via an electrostatic process due to the weave of the polypropylene fabric which has an electrical charge (or electrostatic charge). When the polypropylene fabric is in contact with a patient's body, this charge causes a film of sweat to form over the patient's body surface. This sweat film maintains a constant physiologic surface temperature. Therefore, the material does the work, not the human thermoregulatory physiologic mechanisms. A polypropylene fabric does not allow overheating of a patient, a danger with occlusive or non-porous materials. Accordingly, polypropylene fabric has the best potential for cutaneous surface temperature stabilization of a patient.

DETAILED DESCRIPTION OF THE DRAWINGS

FIG. 1 is a frontal view of a patient clothed in the garment of the present invention. The garment 14 is comprised of a top piece 10 and bottom pieces 12. The openings 2, 4, 6, 8, in the garment 14 are secured, preferably, with a hook and loop tape closure. The openings 2, 4, 6, 8, may be fully open, fully closed or any combination of open and closed as dictated by the needs of the surgical procedure being performed.

The top piece 10, of the garment 14, has opening 2 which extends along an anterior midline. Openings 4 of the top piece 10 extend along a left lateral line and a right lateral line. Openings 6 of the top piece 10 extend along each forearm. Openings 8 of the bottom pieces 12 extend along a left lateral line and a right lateral line.

Figure 2:
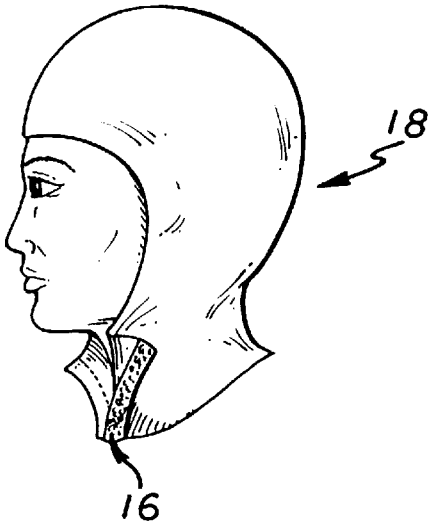
FIG. 2 is a left side view of a patient's head clothed in the hood piece of the garment of the present invention.

FIG. 2 is a side view of a patient's head clothed in the hood piece 18 of the garment 14 of the present invention. The hood piece 18 covers the head and neck of a patient leaving the face exposed for access to a patient for oxygen mask application and other necessary medical procedures. Opening 16 of the hood piece 18 extends along an anterior neck line. The opening 16 allows access to a patient for necessary medical procedures.

Figure 3:
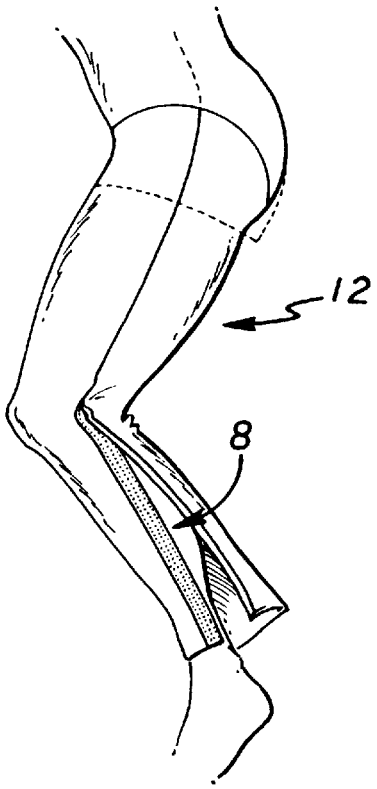
FIG. 3 is a left side view of a patient's left lower extremity or leg clothed in the left bottom piece of the garment of the present invention.

FIG. 3 is a left side view of a patient's left lower extremity clothed in the left bottom piece 12 of the garment 14 of the present invention. The left bottom piece 12 has opening 8 for access to a patient for necessary medical procedures. The opening 8 of the left bottom piece 12 extends along a left lateral line.

The openings 2, 4, 6, 8, 16, disclosed allow for access to a patient as dictated by the most frequently performed surgical procedures. As would be obvious to one of ordinary skill in the art, the garment of the present invention may be modified to meet the needs of a specific surgical procedure.

The embodiments illustrated and discussed in the specification are intended only as exemplary and the many other feasible embodiments within the scope of this invention will be readily understood and appreciated by those of ordinary skill in the art. Nothing in the specification should be considered as limiting the scope of the present invention. Many changes may be made by those of ordinary skill in the art to produce highly effective patient surgical garments without departing from the present invention. The present invention should be limited only by the claims which follow.

We claim:

1. A surgical garment comprising:

a. a top piece for covering a torso and upper extremities of a patient, the top piece having closable openings therein along an anterior midline, along a left lateral line, along a right lateral line, along a left forearm and along a right forearm;

b. a hood piece for covering a head and neck of the patient, the hood piece having a closable opening therein along an anterior neck line; and c. two separate, non-connected bottom pieces for covering lower extremities of the patient, the bottom pieces having closable openings therein along a left lateral line of a left bottom piece and along a right lateral line of a right bottom piece;

wherein the closable openings allow access to the patient: further wherein the garment is form-fitting; and further wherein the garment assists a patient in maintaining homeostasis.

2. The garment of claim 1 wherein the garment is comprised of a fabric which permits cutaneous surface temperature stabilization of the patient, said fabric being selected from the group consisting of polypropylene; a water-proof, breathable fabric; an insulating, water-absorbent fabric; silk; wool; cotton; rayon and polyester.

3. The garment of claim 2 wherein the fabric is polypropylene.

4. The garment of claim 1 wherein the openings are closable with a closure selected from the group consisting of hook and loop tape, snaps, buttons and zippers.

5. The garment of claim 4 wherein the closure is hook and loop tape.

6. The garment of claim 1 wherein at least one sleeve of the top piece is detachable from the top piece.

7. A surgical garment for comprising:

a. a top piece for covering a torso and upper extremities of a patient, the top piece having openings therein along an anterior midline, along a left lateral line, along a right lateral line, along a left forearm and along a right forearm;

b. a hood piece for covering a head and neck of the patient, the hood piece having a closable opening therein along an anterior neck line; and c. two separate, non-connected bottom pieces for covering lower extremities of the patient, the bottom pieces having openings therein along a left lateral line of a left bottom piece and along a right lateral line of a right bottom piece; wherein the closable openings allow access to the patient; further wherein the garment is form-fitting; further wherein the garment assists a patient in maintaining homeostasis and cutaneous surface temperature stabilization; further wherein the garment is comprised of polypropylene fabric, and further wherein the openings are closable with hook and loop tape.

8. The garment of claim 7 wherein at least one sleeve of the top piece is detachable from the top piece.

* * * * *